US006082518A

United States Patent [19]

Itako et al.

[11] Patent Number: 6,082,518

[45] Date of Patent: Jul. 4, 2000

[54] MONEY SCREENING METHOD AND UNIT

[75] Inventors: Eiji Itako, Sakado; Jun Yamada, Kawagoe; Genzo Yoshizawa, Tokyo; Kunio Iwakawa, Tsurugashima; Tsunehiro Aso, Kawagoe, all of Japan

[73] Assignee: Kabushiki Kaisha Nippon Conlux, Japan

[21] Appl. No.: 09/082,374

[22] Filed: May 20, 1998

[30] Foreign Application Priority Data

May 21, 1997 [JP] Japan ..... 9-131257
Jul. 23, 1997 [JP] Japan ..... 9-228780

[51] Int. Cl.[7] ..... G07D 5/08

[52] U.S. Cl. ..... 194/317; 194/328; 194/335

[58] Field of Search ..... 194/317, 318, 194/319, 328, 330, 334, 338, 335

[56] References Cited

U.S. PATENT DOCUMENTS 4,585,936 4/1986 Sellier ..... 194/334 X
4,819,780 4/1989 Trummer et al. ..... 194/330 X
5,392,892 2/1995 Mulder ..... 194/334

*Primary Examiner*—F. J. Bartuska
*Attorney, Agent, or Firm*—Hogan & Hartson LLP

[57] ABSTRACT

The invention provides a money sorting method and unit that can detect such a counterfeit as foreign money for which material, outer diameter and other features are very similar to a genuine coin, and that can decrease damage caused by the continuous trial of entry of counterfeit money. Sensors detect the material of a coin entered from a coin entry section, and at the same time, the outer diameter of the coin is detected by three sensors with a highly accurate method utilizing time ratio, pattern on the surface of the rolling coin is detected by converting output of the sensors to a basic pattern, and genuineness of the entered coin is judged based on these detection results. Detection detects features of the money entered from the money entry section based on output of the feature sensor, comparison judges whether the entered money is genuine or counterfeit, and if the entered money is a counterfeit, the counterfeit money is returned and at the same time an acceptance prohibition timer is activated, and while the acceptance prohibition timer is operating, acceptance is rejected whether the entered money is genuine or counterfeit.

11 Claims, 11 Drawing Sheets

MONEY SCREENING METHOD AND UNIT

BACKGROUND OF THE INVENTION

1. Field of the Invention

The present invention relates to a money screening method and a unit, and more particularly to a money screening method and a unit that can prevent the acceptance of foreign money or counterfeit money which material and outer diameter are very similar to genuine money, and can decrease the ratio of counterfeit money acceptance caused by the trial of continuously entering counterfeit money.

2. Description of the Related Art

Generally a money screening unit used for a vending machine, a money changing machine and service equipment is configured so as to sort coins entered from a coin slot into genuine coins and counterfeit coins, and to accept the screened genuine coins after sorting them by the type of money.

For sorting of coins, a sensor, which is installed on a coin passage for guiding a coin entered from the coin slot to a coin sorting section, detects such features as the material and shape of the coin, and this detection result becomes a base for sorting.

An example of the sensor for detecting features of a coin has a structure that a coil is positioned at one side of the coin passage, and an oscillation circuit is created including this coil. This sensor utilizes the change of inductance of the coil caused by a coin when the coin passes by the coil, and acquires information on the coin that passes by detecting changes of oscillation frequency.

Another example of the sensor has a structure that an oscillation coil which is excited by exciting current with specified frequency is positioned at one side of the coin passage, and a receiving coil is placed at the other side. This sensor utilizes a change of mutual coupling coefficient (magnetic coupling coefficient) between the oscillation coil and the receiving coil caused when a coin passes between the oscillation coil and the receiving coil, and acquires information on the coin that passes by detecting the change of output voltage of the receiving coil.

Inductance or mutual coupling coefficient, which are changed by passing of a coin, differ depending on the material of the coin, therefore, the material of the coin can be detected by the output whichever type of the above described sensors is used, and if oscillation frequency or exciting frequency is low, the surface material of the coin can be detected, whereas if oscillation frequency or exciting frequency is high, the internal material of the coin can be detected.

Outer diameter of a coin can be detected by adjusting the location of the sensor that is placed at the coin passage, because the height (area) of a coin which passes the coin passage differs depending on the diameter, therefore if the sensor is placed at a specified height, output becomes different depending on the coin that passes.

Generally, a conventional coin screening unit has the above described sensor for detecting material and outer diameter of a coin, and uses one or more sensors depending on the application.

In a conventional coin screening unit, however, genuineness of an entered coin is judged by material and outer diameter of the coin, therefore a coin which has a very similar material and outer diameter as a genuine coin, such as a foreign coin, is accepted as a genuine coin, and actual crimes using this shortcoming occur frequently.

Also when the above sensor is used for detecting money, the detection result varies even among the same type of money due to contamination of the coin and other factors, therefore an upper limit and lower limit are set in judgment data for sorting genuine money and counterfeit money, and money is judged as genuine when the detection result is within this range.

As a consequence, sorting of genuine money and counterfeit money is not always successful, and counterfeit money may be erroneously accepted as genuine, and even if the acceptance rate of counterfeit money is several percent or less, a counterfeit money may be accepted as genuine by the trial of continuously entering the counterfeit coin.

Particularly in the case of coins, there are many foreign coins which have similar material, outer diameter, and thickness, and crimes of stealing money and objects by altering such foreign coins frequently occur these days.

If a more strict sorting standard between genuine money and counterfeit money is set to prevent the acceptance of counterfeit money, then a slightly contaminated genuine money will be judged as counterfeit, which as a result will decrease functions of the money screening unit.

SUMMARY OF THE INVENTION

An object of the present invention is to provide a money screening method and a unit which allows detection of money which material and outer diameter are very similar to genuine money, such as foreign money.

Another object of the present invention is to provide a money screening method and a unit which allows decreasing damage caused by the trial of continuously entering counterfeit money.

To achieve these objects, the invention provides a money screening method comprising the steps of: detecting features of a coin rolling through a coin passage by a plurality of sensors disposed along the coin passage; judging genuineness of the coin based on a detection result; accepting the coin if it is judged as genuine in the judgment and returning the coin if it is judged as counterfeit in the judgment, wherein the plurality of sensors are disposed at a specified interval along the coin passage; the outer diameter of the coin is detected based on a time difference in detection of entry of the coin by each of the plurality of sensors; and the genuineness of the coin is judged based on the detection result.

Here, it can be configured such that the plurality of sensors are at least three sensors, and the outer diameter of the coin is detected by comparing a preset reference value with a ratio between a time one, which is a time from when a first sensor among the three sensors first detects entry of the coin to when a second sensor among the three sensors secondly detects entry of the coin, and a time two, which is a time from when the first sensor detects entry of the coin to when a third sensor among the three sensors thirdly detects entry of the coin.

The coin passage can be configured to have a base which is inclined at a specified angle toward a direction perpendicular to a coin rolling direction.

Also, the invention provides a money screening method comprising the steps of: detecting features of a coin rolling through a coin passage by a at least one sensor disposed along the coin passage; judging genuineness of the coin based on a detection result; accepting the coin if it is judged as genuine in the judgment and returning the coin if it is judged as counterfeit in the judgment, wherein an output of the sensor is summarized to a specific number of data; the summarized data is converted to basic pattern data; the converted basic pattern data is compared with reference data which has been set in advance for each money type; and genuineness of the coin is judged based on a comparison result.

Here, the summarization can be implemented by selecting a specified number of data out of change points where the output of the sensor changes from ascending to descending and from descending to ascending, and the conversion is implemented by rearranging the summarized data in specified sequence.

The genuineness judgment of the coin can be implemented based on a discrete value indicating a difference between the basic pattern data for each one of multiple items and the reference data and a sum of the discrete values corresponding to all of the multiple items.

The comparison can be performed also for the reference data corresponding to a counterfeit coin similar to a genuine coin; and when the result of the comparison is judged as applicable to both of the genuine coin and the counterfeit coin, the coin is judged as applicable to the genuine coin or the counterfeit coin for which approximity is higher in the comparison result.

Also, the invention provides a money screening method comprising the steps of: detecting features of a coin rolling through a coin passage by a plurality of sensors disposed at a specified interval along the coin passage; judging genuineness of the coin based on a detection result; accepting the coin if it is judged as genuine in the judgment and returning the coin if it is judged as counterfeit in the judgment, wherein the plurality of sensors detect at least a material, an outer diameter and a surface pattern of the coin; the diameter is detected by detecting features including a thickness of the coin based on a time difference in detection of entry of the coin by the plurality of sensors in the coin passage whose base is inclined at a specified angle toward a direction perpendicular to the coin rolling direction; the surface pattern is detected by summarizing outputs of the sensors to specified number of data, converting the summarized data to basic pattern data, and comparing the converted basic pattern data with reference data which has been set in advance for each money type; and each detection result is compared with reference values which have been set in advance, and genuineness of the coin is judged based on the comparison result.

Further, the invention provides a money screening unit which comprises: a plurality of sensors disposed at a specified interval along a coin passage; time difference detection means for detecting a time difference in detection of entry of the coin by the plurality of sensors; and outer diameter detection means for detecting an outer diameter of the coin based on the time difference detected by the time difference detection means.

Here, it can be configured such that the plurality of sensors are at least three sensors; and the time difference detection means comprises: first time difference detection means for detecting a time one from when a first sensor among the three sensors first detects entry of the coin to when a second sensor among the three sensors secondly detects entry of the coin; and second time difference detection means for detecting a time two from when the first sensor detects entry of the coin to when a third sensor among the three sensors thirdly detects entry of the coin, and the outer diameter detection means comprises: time ratio calculation means for calculating a ratio between a time detected by the first time difference detection means and a time detected by the second time difference detection means; and time ratio comparison means for comparing the ratio calculated by the time ratio calculation means and a preset reference value.

The coin passage can be configured to have a base which is inclined at a specified angle toward a direction perpendicular to the coin rolling direction.

Also, the invention provides a money screening unit which comprises: at least one sensor disposed at a coin passage; data summarization means for summarizing an output of the sensor to a specified number of data; basic pattern data conversion means for converting the data summarized by the summarization means to basic pattern data; basic pattern data comparison means for comparing the basic pattern data acquired after conversion by the basic pattern conversion means with reference data which has been set in advance for each money type; and coin screening means for detecting features of the coin rolling through the coin passage based on the comparison result by the basic pattern data comparison means, judging genuineness of the coin based on the detection result, accepting the coin if it is judged as genuine in the judgment and returning the coin if it is Judged as counterfeit in the judgment.

Here, the summarization means comprises: change point detection means for detecting a change point where the output of the sensor changes from ascending to descending and from descending to ascending; and data selection means for selecting a specified number of data from the data on the change points detected by the change point detection means, and the basic pattern conversion means rearranges the data summarized by the summarization means to a specified sequence.

In addition to the above configuration, it can be configured to further comprise discrete value calculation means for calculating a discrete value that indicates a difference between the basic pattern data and the reference data for each one of multiple items; and total discrete value calculation means for calculating the sum of the discrete values for all of the multiple items.

The basic pattern data comparison means further comprises approximity judgment means for comparing the basic pattern data with the reference data for a counterfeit coin similar to a genuine coin, and when the comparison result is judged as applicable to both the genuine coin and the counterfeit coin, judging the coin as applicable to the genuine coin or the counterfeit coin for which approximity is higher in the comparison result.

Further, the invention provides a money screening unit which comprises: a plurality of sensors disposed at a specified interval along a coin passage; coin material detection means for detecting a material of the coin based on outputs of the plurality of multiple sensors; coin outer diameter detection means for detecting an outer diameter of the coin based on a time difference in detection of entry of the coin by the plurality of sensors; coin pattern detection means where the outputs of the sensors are summarized to a specified number of data, the summarized data is converted to basic pattern data, and a surface pattern of the coin is detected by comparing the basic pattern data with reference data which has been set in advance for each money type; judgment means for judging genuineness of the coin based on the detection outputs of the coin material detection means, the coin outer diameter detection means and the coin pattern detection means; and coin screening means for accepting the coin judged as genuine by the judgment means and returning the coin judged as counterfeit by the judgment.

As described above, the present invention allows accurate detection of a counterfeit coin, such as a foreign coin, which material, outer diameter and patterns are extremely similar to a genuine coin, because of the configuration where not only the material of the entered coin is detected, but also outer diameter of the coin is detected with a high accuracy utilizing time ratio, and a pattern on the surface of the rolling coin is detected by converting output of the sensor into a basic pattern, and then genuineness of the entered coin is judged based on these detection results.

Further, the invention provides a money screening method comprising the steps of: detecting features of an entered money; judging genuineness of the money based on the detection result; accepting the money if it is judged as genuine in the judgment and returning the money if it is judged as counterfeit in the judgment, wherein when the entered money is judged as counterfeit in the judgment, a specified time is measured from an entry time point of the money judged as counterfeit, and acceptance of next money is prohibited during measuring the specified time.

Here, a specified number of previous judgment results by the judgment is stored, and measurement of the specified time is started only when the number of money judged as counterfeit exceeds a specified number in the stored previous judgment result.

It can be configured such that the specified time is extended if new money is entered during measuring the specified time.

It can be configured such that the measurement of the specified time and the prohibition of acceptance of money are performed for each money type of the entered money.

Further, the invention provides a money screening unit which comprises: feature detection means for detecting features of entered money; judgment means for judging genuineness of the money based on the detection result of the detection means; money sorting means for accepting the money judged as genuine by the judgment means and returning the money judged as counterfeit by the judgment means; timer means for measuring a specified time from a time point of entry of the money when the money is judged as counterfeit by the judgment means; and money acceptance prohibition means for prohibiting acceptance of next money while the timer means is operating.

The unit further comprises storage means for storing a specified number of previous judgment results by the judgment means, wherein the timer means is activated only when the number of money judged as counterfeit exceeds the specified number in the storage means.

It can be configured such that the timer means comprises measurement time extension means for extending the specified time when money is entered while the timer means is operating.

It can also be configured such that the timer means and the money acceptance prohibition means are equipped for each type of the money, and operate for each type of the entered money.

As described above, the present invention can decrease the rate of acceptance of counterfeit money due to continuous trials of entry since when the money entered from a money entry section is judged as counterfeit, the counterfeit money is returned and at the same time the acceptance prohibition timer is activated, and while the acceptance prohibition timer is operating, acceptance is rejected regardless whether the entered money is genuine or counterfeit.

This also allows acceptance of a contaminated genuine money, unlike the case when the sorting standard of a genuine money and counterfeit money is made to be more strict.

DESCRIPTION OF THE PREFERRED EMBODIMENTS

An embodiment of a money screening method and a unit of the Invention will now be described with reference to the accompanying drawings.

Figure 1:
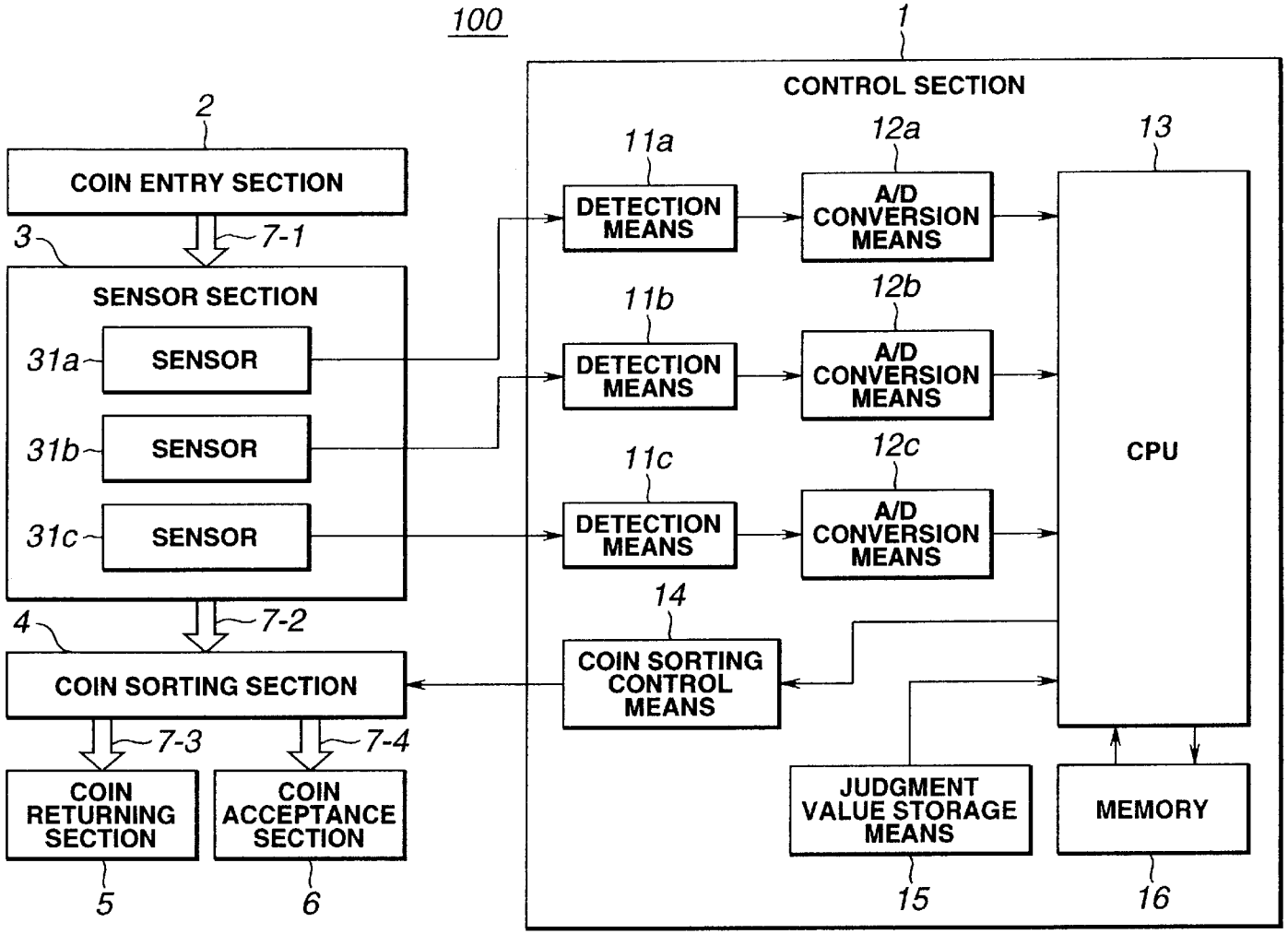
FIG. 1 is a block diagram depicting the configuration of a coin screening unit configured applying the money screening method and unit of the present invention.

FIG. 1 is a block diagram depicting the configuration of a coin screening unit configured applying a money screening method and a unit of the invention.

In FIG. 1, a coin screening unit 100 comprises a control section 1 for controlling the screening of an entered coin, a coin entry section 2 which is an entry slot of a coin, a sensor section 3 for detecting features of a coin, a coin sorting section 4 for sorting the entered coin based on control of the control section 1, a coin returning section 5 for returning the entered coin, a coin acceptance section for accepting the entered coin, and a coin passage 7 (7-1, 7-2, 7-3, 7-4) where the entered coin passes through.

The sensor section 3 comprises a sensor 31*a* for primarily detecting material of the coin, a sensor 31*b* for primarily detecting outer diameter of the coin, and a sensor 31*c* for primarily detecting surface pattern on the coin, and the control section 1 comprises detection means 11*a* to 11*c* for detecting information on the coin from the detection result of sensors 31*a* to 31*c* respectively, A/D conversion means 12*a* to 12*c* for converting analog signal information detected by the detection means 11*a* to 11*c* to digital signal information, CPU 13 for performing judgment processing for the coin based on the information on the coin which was input via the A/D conversion means 12*a* to 12*c*, coin sorting control means 14 for controlling the coin sorting section 4 based on the judgment result by CPU 13, judgment value storage means 15 for storing judgment values which CPU 13 needs for judgment processing of the coin, and a memory 16 which further comprises RAM for temporarily storing information and ROM where processing instructions and other data are stored.

Figure 2:
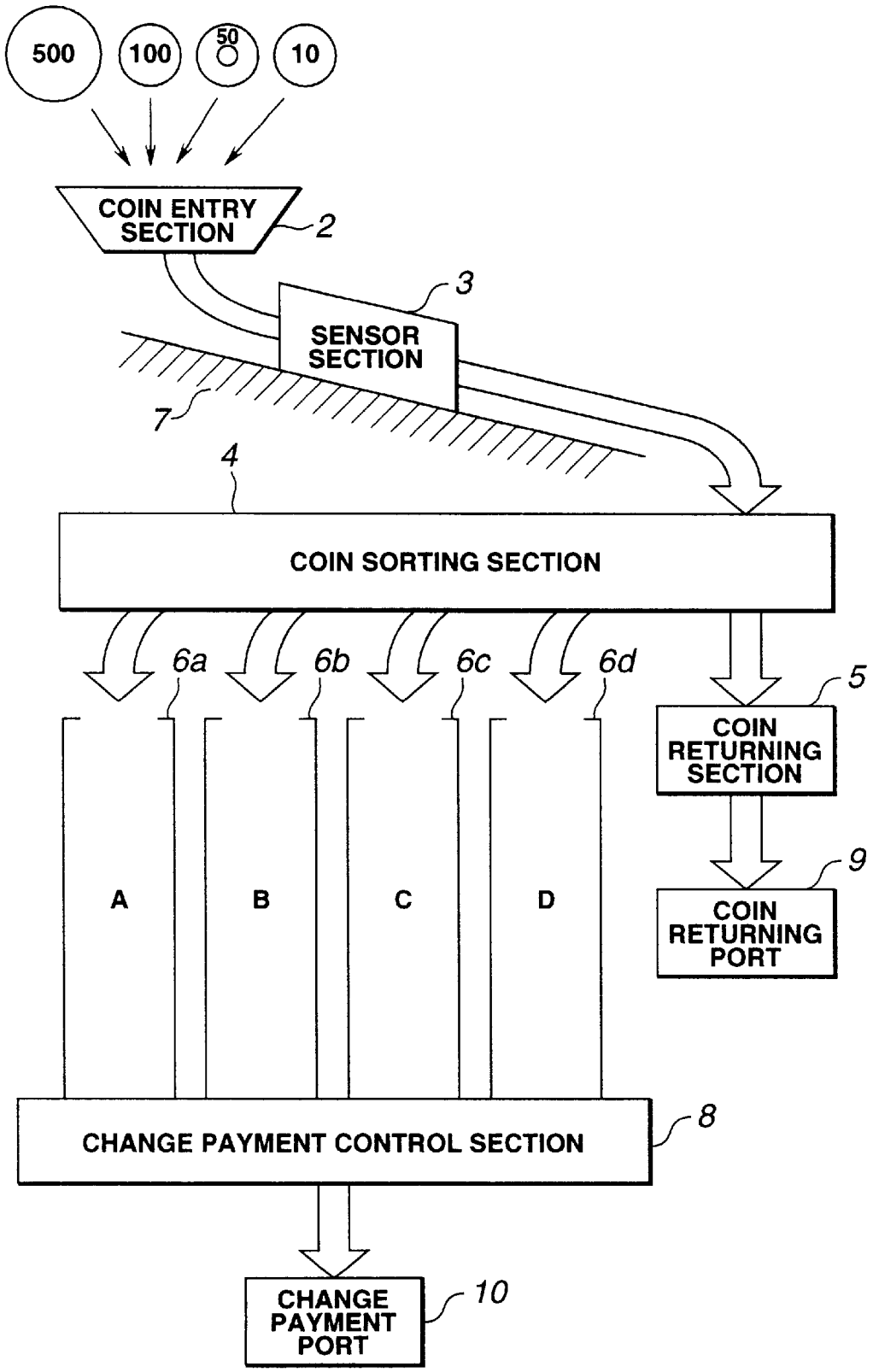
FIG. 2 is a schematic drawing depicting flow of a coin in the coin screening unit shown in FIG. 1.

Here, the flow of the coin entered into the coin screening unit 100 is described referring to FIG. 2.

FIG. 2 is a schematic drawing indicating the flow of a coin in the coin sorting unit 100.

In the coin screening unit shown in FIG. 2, the coin acceptance section 6 is separated into the coin acceptance section 6*a* to 6*d* so that the entered coin can be accepted according to the type of money (this is omitted in FIG. 1). A change payment control section 8 which is not shown in FIG. 1 is added in this configuration so that a coin accepted by the coin acceptance section 6*a* to 6*d* can be paid out as change.

A coin entered from the coin entry section is transferred to the coin sorting section 4 via the coin passage 7, and during this transfer, the sensor section 3 detects the features of the coin, output of the sensor section 3 is input into the control section 1, the control section 1 selects genuineness and money type of the coin based on the output of the sensor section 3 and controls the coin sorting section 4.

The coin sorting section 4 sorts the coin transferred via the coin passage 7 based on the control signal from the control section 1.

When the control section recognizes the coin as counterfeit, the coin is channeled to the coin returning section 5, and is returned from the coin returning port 9 (not illustrated in FIG. 1) to the individual who entered the coin.

When the coin control section 1 recognizes the coin as genuine, the coin is channeled to the coin acceptance section 6, and in this case, the coin is further channeled to one of the coin acceptance sections 6*a* to 6*d* according to the type of money.

The coin channeled to the coin sorting sections 6*a* to 6*d* is returned from the change payment port 10 (not illustrated in FIG. 1) as change if necessary, by the control of the change payment control section 8.

The sensor section 3 of the coin screening unit 100 has three sensors, sensors 31*a* to 31*c*, and these sensors detect material, outer diameter and pattern of the coin.

Material of the coin is detected by the sensor 31*a* in the same method as a conventional coin screening unit, therefore a description is omitted here.

Outer diameter of the coin is detected by the sensor 31*b* in the same method as a conventional coin screening unit (description is omitted here), then is further detected by the output of the three sensors, sensors 31*a* to 31*c*.

Pattern on the surface of the coin is detected by the output of the sensor 31*c*.

Figure 3A:
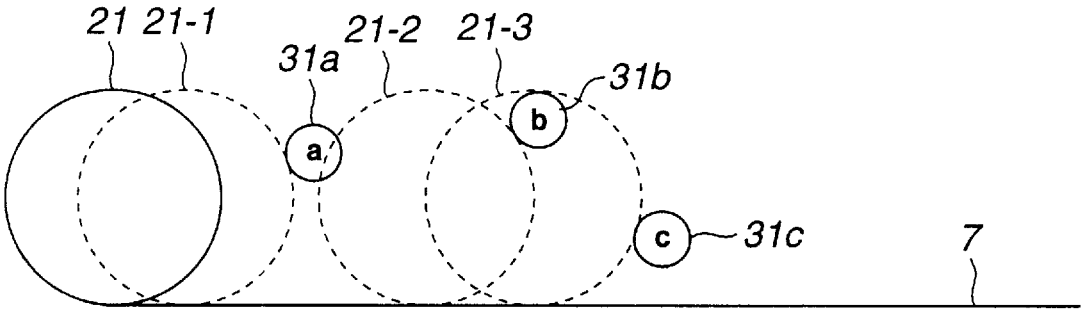
FIGS. 3(*a*) to 3(*c*) are diagrams depicting examples of placement of sensors and locuses of a coin at the sensor section shown in FIG. 1.
Figure 3B:
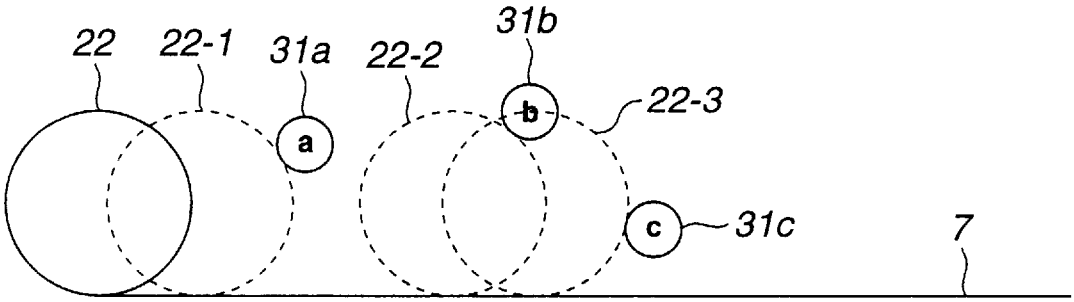
Figure 3C:
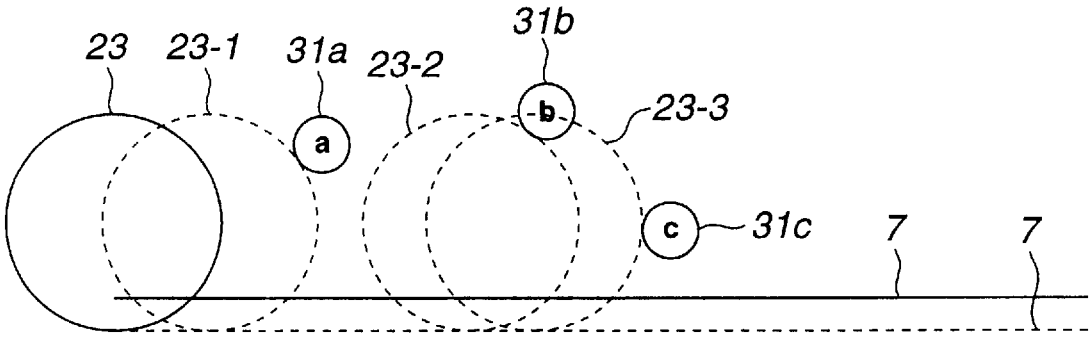
Figure 4A:
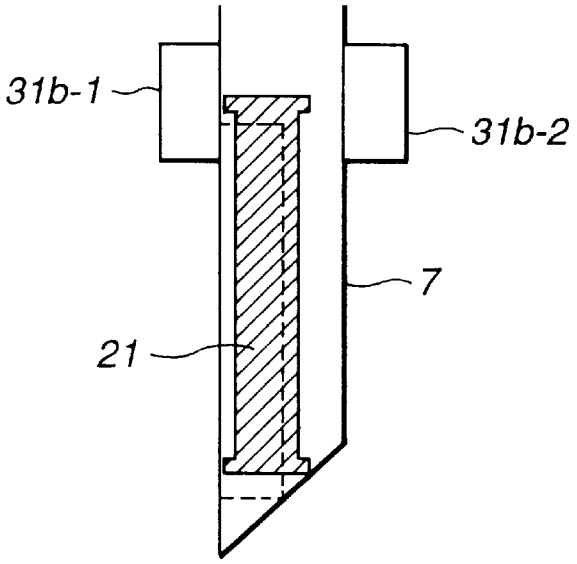
FIGS. 4(*a*) and 4(*b*) are cross-sectional views of a coin passage at the sensor section shown in FIG. 1.
Figure 4B:
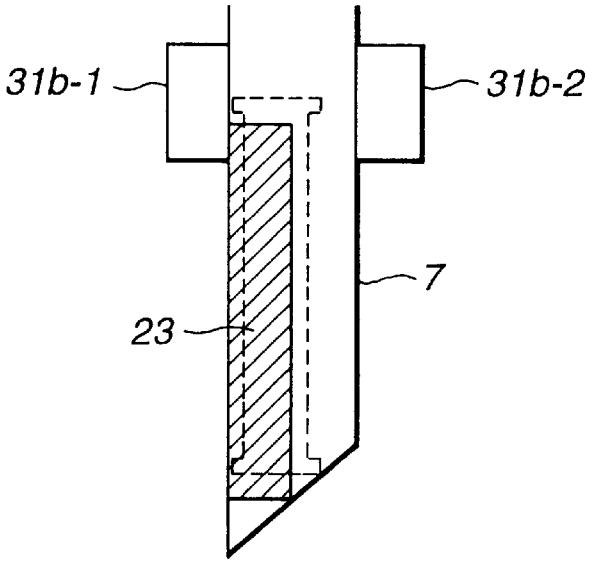
Figure 5A:
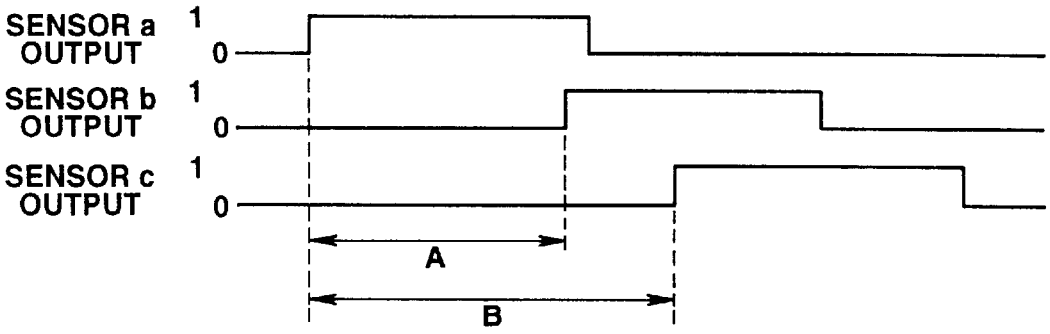
FIGS. 5(*a*) to 5(*c*) are diagrams depicting detection output of the sensor shown in FIG. 1.
Figure 5B:
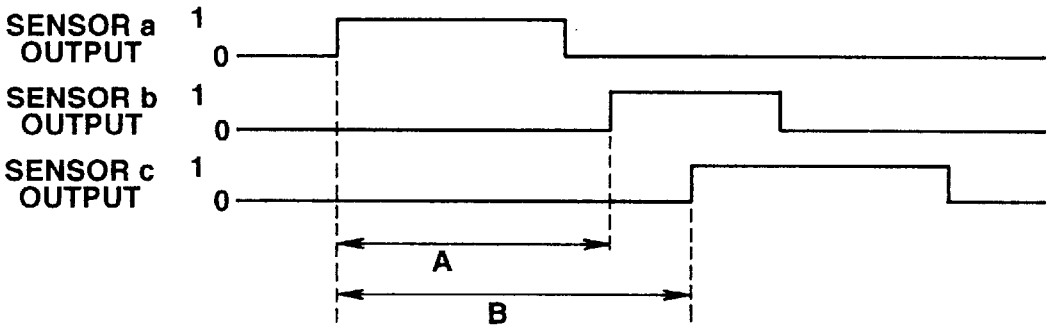
Figure 5C:
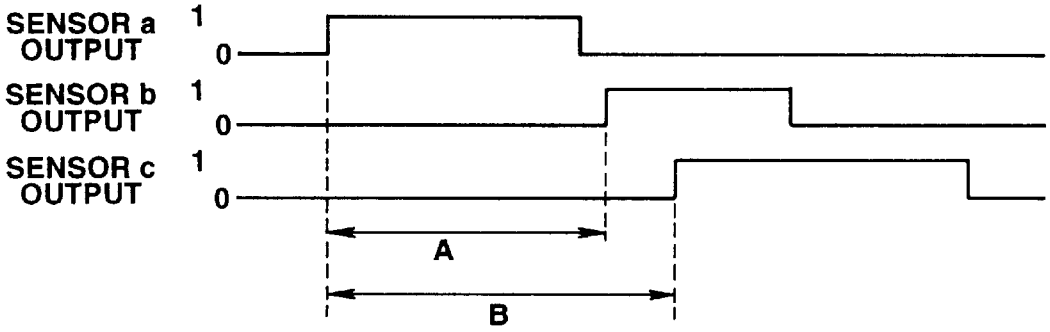

The method for detecting outer diameter of the coin using the three sensors, sensors 31*a* to 31*c*, is described first, referring to FIGS. 3 to 5.

FIG. 3 is a diagram indicating examples of arrangement of the sensors 31*a* to 31*c* and loci of the coin at the sensor section 3, FIG. 4 is a cross-sectional view of the coin passage 7 at the sensor section 3, and FIG. 5 is a diagram depicting detection output of the sensors 31*a* to 31*c*.

The sensors 31*a* to 31*c* are arranged as shown in FIG. 3 here, but the sensors can be arranged in any pattern only if the sensors can detect both a coin which has the minimum diameter and a coin which has the maximum diameter among the target coins to be received by the coin screening unit 100.

The coin passage 7 of the sensor section 3 has an inclined base as shown in FIG. 4, so that the passing position in the height direction changes depending on the thickness of the coin passing through.

FIG. 3 (*a*) shows loci 21-1 to 21-3 of a coin 21 passing through the sensor section 3, FIG. 3 (*b*) shows loci 22-1 to 22-3 of a coin 22, which has a smaller diameter and the same thickness as the coin 21, passing through the sensor section 3, and FIG. 3 (*c*) shows loci 23-1 to 23-3 of a coin 23, which has the same diameter as and different thickness from the coin 21, passing through the sensor section 3.

The loci of the coin 21 and the coin 23 which have the same diameter are different, because the base of the coin passage 7 is inclined, where the coin 21 (see FIG. 4(*a*)) and the coin 23 (see FIG. 4(*b*)) have different passing positions in height direction, as shown in FIG. 4.

FIG. 5 shows each output of the sensors 31*a* to 31*c* when the coins 21 to 23 have passed through the sensor section 3.

FIG. 5(*a*), (*b*) and (*c*) correspond to FIG. 3(*a*), (*b*) and (*c*) respectively, where FIG. 5(*a*) shows detection output of each sensor when the coin 21 has passed, FIG. 5(*b*) shows detection output of each sensor when the coin 22 has passed, and FIG. 5(*c*) shows detection output of each sensor when the coin 23 has passed.

As FIG. 5 shows, timing and detection (duration) when the sensors 31*a* to 31*c* detect the coin differ depending on outer diameter, including diameter and thickness of the entered coin. However, even if the same type of coins are entered, outputs are not always the same because the speed of the coins when they pass through the sensor section 3 is not always the same.

Now time from the start point when the sensor 31*a* detects entry of a coin until the point where the sensor 31*b* and the sensor 31*c* detect entry of the coin is measured, and the time ratio T is calculated. When time from detection of entry of the coin by the sensor 31*a* to detection of entry of the coin by the sensor 31*b* is A, and time from detection of entry of the coin by the sensor 31*a* to detection of entry of the coin by the sensor 31*c* is B, the time ratio T is defined as formula (1).

$$T=A/B \tag{1}$$

Since the time ratio T allows absorption of the dispersion of speed when coins are passing through the sensor section 3, and the time ratio T is a different value depending on the type of the coin, outer diameter of the coin including thickness can be judged by comparing the time ratio T and a value specified for each coin.

The method for detecting pattern on the surface of a coin utilizing detection output of the sensor 31*c* is described next.

To detect pattern on the surface of a coin is, the sensor 31*c* detects the irregularity type of the surface of the coin entered into the sensor section 3, and compares the detected type and Judgment reference pattern, but the number of irregularity types the sensor 31*c* would detect is infinite because a coin normally has different patterns on the front and back sides, and the coin enters the sensor section while rolling.

Even if an infinite number of irregularity types exist, however, some feature exists in the detected data when irregularity of the same pattern is detected.

So if basic pattern conversion processing is performed for editing output of the sensor 31*c* to a basic pattern, then pattern on the surface of the coin can be detected by comparing the basic pattern with the judgment reference pattern.

Figure 6A:
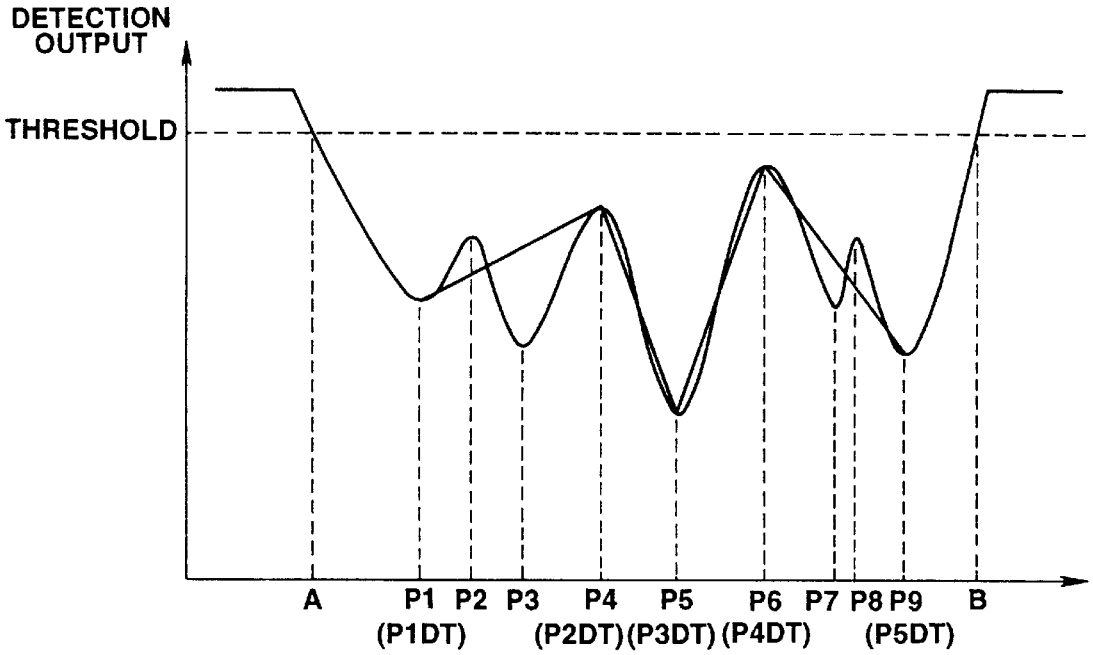
FIGS. 6(*a*) and 6(*b*) are diagrams of output data of the sensor shown in FIG. 1 and data when the output data is converted to a basic pattern.
Figure 6B:
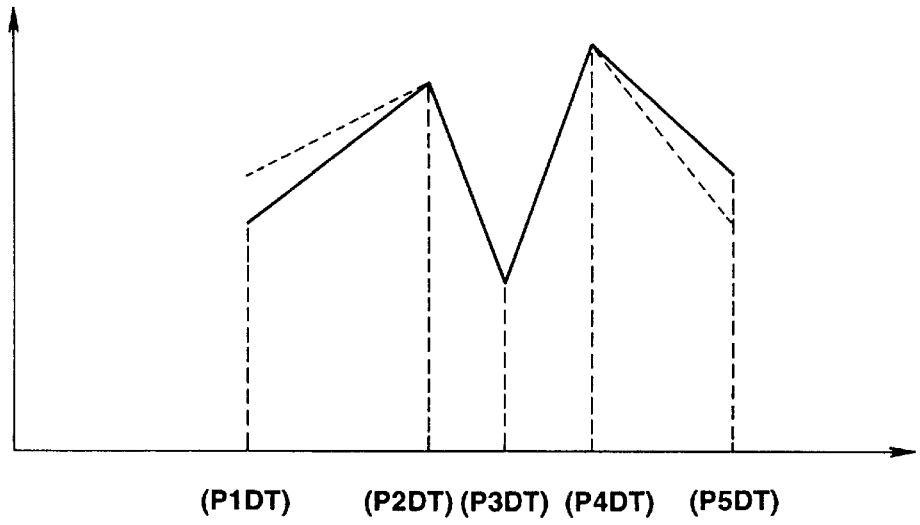

FIG. 6 shows a diagram depicting output data of the sensor 31*c* and data when the output data is converted to the basic pattern.

As FIG. 6(*a*) shows, output of the sensor 31*c* is a waveform that changes according to the irregularity on the surface of the coin, and change points (inflection points) where the waveform changes from ascending to descending and from descending to ascending are stored in the memory 16 as data, and the data is summarized into a specified number of data for converting the data to the basic pattern.

The number of data to which the data is summarized into can be any odd number, but "5" is used here considering the absorbing dispersion of data that each coin has.

Now a method for basic pattern conversion processing of output data is described.

Figure 7:
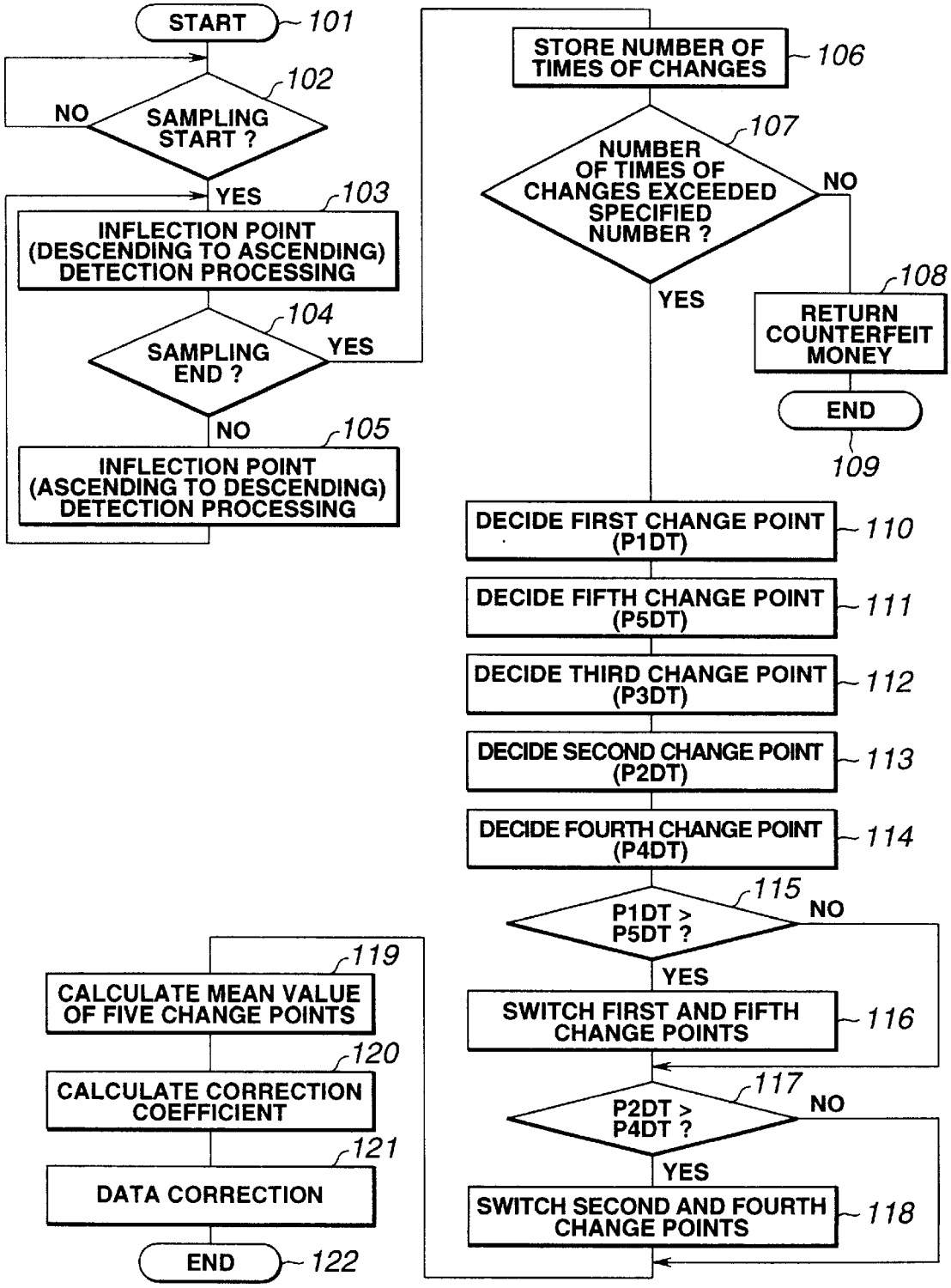
FIG. 7 is a flow chart indicating the flow of basic pattern conversion processing for the output data of the sensor shown in FIG. 1.

FIG. 7 shows a flow chart indicating the flow of basic pattern conversion processing of output data.

When detection of pattern on the surface of the coin starts (Step 101), and detection output of the sensor 31*c* becomes lower than the threshold (point A of FIG. 6(*a*)), data sampling starts (YES in Step 102) and the inflection point P1 where descending changes to ascending is detected (Step 103).

Then data sampling continues if detection output of the sensor 31*c* remains lower than the threshold (NO in Step 104), and the inflection point P2 where ascending changes to descending is detected (Step 105).

Detection of inflection points in Step 103 and Step 105 continues until sampling of data ends (inflection points P1 to P9 are detected), and when detection output of the sensor 31*c* becomes higher than threshold (point B of FIG. 6(*a*)), sampling of data ends (YES in Step 104), and the number of times of changes (number of inflection points) is stored in the memory 16 (Step 106).

If the number of changes stored in the memory 16 is smaller than a specified number of times (NO in Step 107), then the coin is clearly a counterfeit that has less irregularity on its surface, therefore the coin is returned as a counterfeit coin (Step 108) and processing ends (Step 109).

If the number of changes stored in the memory 16 is more than a specified number of times, then the first change point P1 is defined as the first change point P1DT (Step 110) and the last change point P9 is defined as the fifth change point P5DT (Step 111).

Then the change point P5, which has the smallest value among the change points excluding the change points defined as the first change point P1DT and the fifth change point P5DT (P1 and P9), is defined as the third change point P3DT (Step 112).

Since the first change point P1DT, the third change point P3DT, and the fifth change point P5DT are all data on a convex section of the coin (an inflection point where descending changes to ascending), the concave sections of the coin is discerned next.

To discern the concave sections, the change point P4, which has the largest value in the range from the first change point P1DT to the third change point P3DT, is defined as the second change point P2DT (Step 113), and the change point P6, which has the largest value in the range from the third change point P3DT to the fifth change point P5DT, is defined as the fourth change point P4DT (Step 114).

Out of the defined five change points, the first change point P1DT and the fifth change point P5DT are data for evaluating the shape of the periphery of the coin, and the second change point P2DT, the third change point P3DT, and the fourth change point P4DT, are data for evaluating the irregularity (pattern) on the coin.

With the processing thus far, summarization of detection output of the sensor 31*c* ends, and subsequent processing is processing for basic pattern conversion.

In the basic pattern conversion processing, the value of the first change point P1DT and the value of the fifth change point P5DT are compared first (Step 115), and if the value of the first change point P1DT is greater (YES in Step 115), then the value of the first change point P1DT and the value of the fifth change point P5DT are switched (Step 116), so that these points are rearranged in the sequence of smaller to greater value.

Then the value of the second change point P2DT and the value of the fourth change point P4DT are compared (Step 117), and if the value of the second change point P2DT is greater (YES in Step 117), then the value of the second change point P2DT and the fourth change point P4DT are switched (Step 118).

The detected data has been converted to the basic pattern by the processing from Step 115 to 118 (see FIG. 6(*b*)), and in processing in subsequent Steps 119 to 121, the value of each change point is corrected for dispersion of each coin screening unit due to the characteristics of the sensors and assembly, and for the voltage variation due to temperature and age deterioration, so that patterns can be judged under a specified standard.

A mean value DTAVE of the first to fifth change points (P1DT P5DT) is calculated first (Step 119), and the correction coefficient HOS is calculated from the formula (2) using the pattern standard average PTNMAS which has been set in advance (stored in the memory 16) for each coin screening unit (Step 120).

Then a value of each change point is corrected using the formula (3) (Step 121), and processing ends.

$$HOS=PTNMAS/DTAVE \quad (2)$$

$$PnDT'-PnDT\times HOS\ (n-1-5) \quad (3)$$

Now a genuineness judgment processing method for judging genuineness of an entered coin using the detected data converted to basic pattern is described.

For the judgment processing, multiple judgment elements which have been calculated from many sampling data and stored in the judgment value storage means 15, and such Judgment values as standard average and standard deviation of data corresponding to multiple judgment money types are used.

Figure 8:
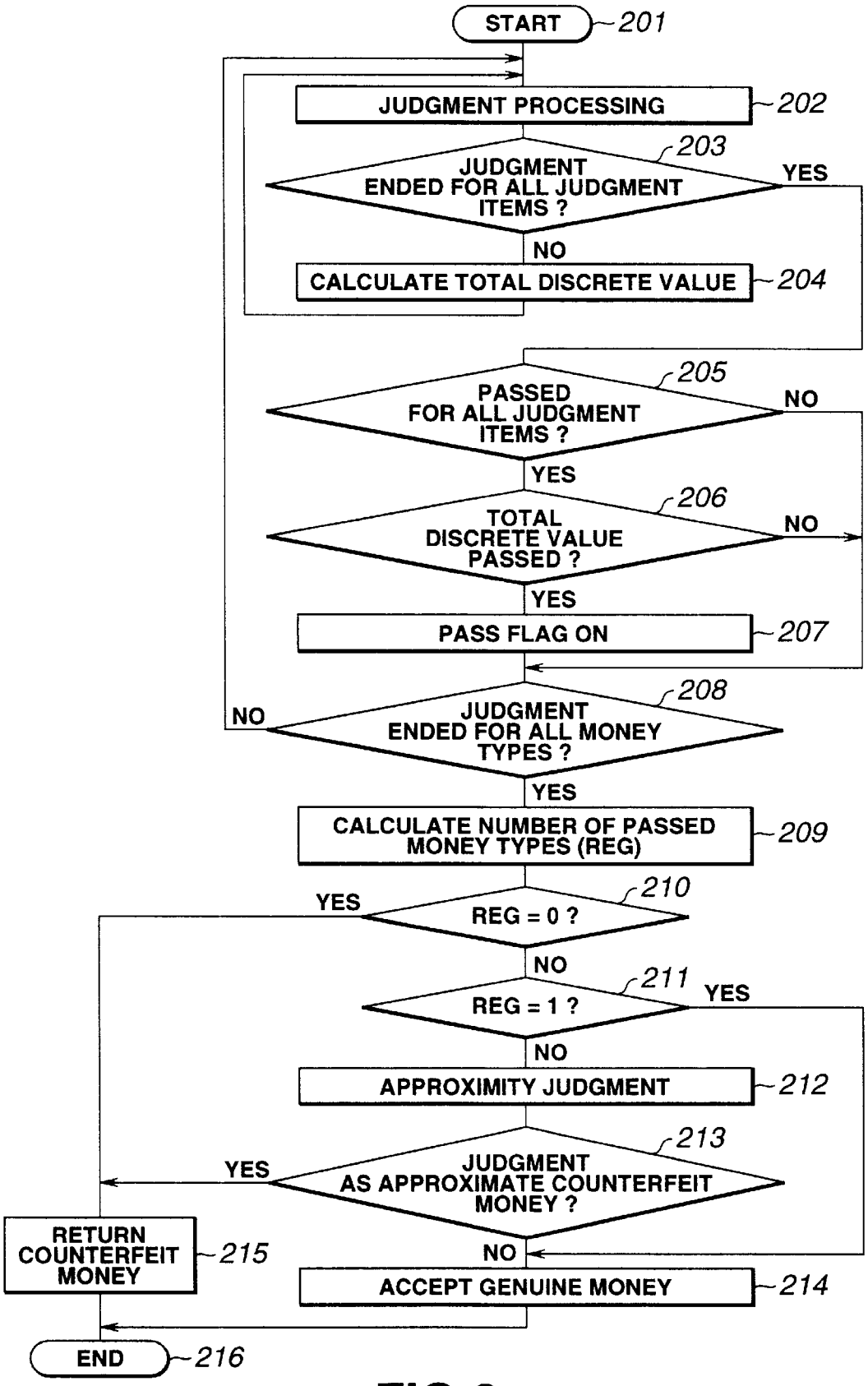
FIG. 8 is a flow chart indicating the flow of genuineness judgment processing of the coin screening unit shown in FIG. 1.

FIG. 8 shows a flow chart indicating the flow of the genuineness judgment processing.

When the genuineness judgment processing starts (Step 201), the judgment processing is executed for one of multiple judgment items (Step 202). The judgment items will be described later, but the judgment processing here is for comparing detected data converted to a basic pattern and a judgment value stored in the memory 16, so as to judge genuineness of the coin, and for calculating a discrete value according to the comparison result.

This judgment processing is repeated until processing for all the items ends (NO in Step 203), and the total discrete value which is the cumulation of the discrete value acquired for each judgment processing is calculated during this time (Step 204).

When judgment processing ends for all the items (YES in Step 203), and if the result of all the judgment items passes (YES in Step 205), and the total discrete value passes (YES in Step 206), a flag indicating pass in the judgment is set to ON for the money type (Step 207).

Processing in these Steps 202 to 207 is executed for all the money types (NO in Step 208), and judgment for all the money types ends (YES in Step 208), and the number of money types that passed the judgment REG as is determined from the number of judgment flags that are ON (Step 209).

If the number of money types that passed the judgment REG is "0" (YES in Step 210) here, this means that the entered coin was judged as a counterfeit, so the coin is returned as a counterfeit coin (Step 215) and the genuineness judgment processing ends (Step 216), and if the number of money types that passed the judgment REG is "1" (NO in Step 210 and YES in step 211), it means that the entered coin was judged as genuine, so the coin is accepted as a genuine coin (Step 214), and the genuineness judgment processing ends (Step 216).

If the number of money types that passed the judgment REG is "2" or more (NO in Step 210 and NO in Step 211), an approximity judgment is executed (Step 212), and if the coin is judged as an approximate counterfeit coin (YES in Step 213), then the entered coin is returned as a counterfeit coin (Step 215) and the genuineness judgment processing ends (Step 216), and if the coin is not judged as an approximate counterfeit coin (NO in Step 213), then the entered coin is accepted as a genuine coin (Step 214) and the genuineness judgment processing ends (Step 216).

The approximity judgment in Step 212 is executed for an altered coin or a foreign coin which is very similar to a genuine coin (hereafter called bad coin) which cannot be judged by individual judgment in Step 202, and in this processing, such judgment values as standard average and standard deviation of a bad coin has been set based on many sample data on the target bad coin, and judgment for the bad coin has been executed just like a genuine coin during the processing in Steps 202 to 208 in advance, then it is judged which one of judgment values, including the values for a genuine coin and a bad coin, is closest to the total discrete value calculated in Step 204.

The judgment processing method in Step 202 (method for calculating a discrete value) is described next. Although eight types of judgment processing methods are described here, these are merely examples, and the judgment processing can be executed by another method.

A. Judgment for each change point (pattern judgment)

Difference between the standard average PnAVE of each change point and the corrected detection data PNDT' corresponding to the standard average is determined and divided by the standard deviation Pnσ, this is the discrete value (see the formula (4)), which is determined for all of the five change points, and is compared with the judgment value for judging genuineness.

$$\text{Discrete value } (1, n) = \text{ABS } (\text{PnAVE} - \text{PnDT'})/\text{Pn}\sigma \quad (n=1-5) \tag{4}$$

B. Judgment by total of pattern discrete values

Total of discrete values of five change points calculated in A is determined, and is compared with the judgment value for judging genuineness.

C. Irregularity difference judgment 1

Judgment is made using the difference between the concave section and convex section in the first half of the pattern when the irregularity of the pattern on the surface of the coin is converted to a basic pattern, where the difference between the standard average P23AVE of the difference between the second change point and the third change point and the difference P23DT between the corrected detection data P2DT' and P3DT' is determined and is divided by the standard deviation P23σ, and the result is the discrete value (see formula (5)), which is compared with the judgment value for judging genuineness.

$$\text{P23DT} = \text{P2DT'} - \text{P3DT'}$$

$$\text{Discrete value } (2) = \text{ABS } (\text{P23AVE} - \text{P23DT})/\text{P23}\sigma \tag{5}$$

D. Irregularity difference judgment 2

Judgment is made using the difference between the concave section and convex section in the latter half of the pattern when the irregularity of the pattern on the surface of the coin is converted to the basic pattern, where the difference between the standard average P34AVE of the difference between the third change point and the fourth change point and the difference P34DT between the corrected detection data P3DT' and P4DT' is determined and is divided by the standard deviation P34σ, and the result is the discrete value (see formula (6)), which is compared with the judgment value for judging genuineness.

$$\text{P34DT} = \text{P3DT'} - \text{P4DT'}$$

$$\text{Discrete value } (3) = \text{ABS } (\text{P34AVE} - \text{P34DT})/\text{P34}\sigma \tag{6}$$

E. Periphery—center difference judgment 1

Judgment is made using the difference between the periphery and the center in the first half of the pattern when the irregularity of the pattern on the surface of the coin is converted to the basic pattern, where the difference between the standard average P13AVE of the difference between the first change point and the third change point and the difference P13DT between the corrected detection data P1DT' and P3DT' is determined and is divided by the standard deviation P13σ, and the result is the discrete value (see formula (7)), which is compared with the judgment value for judging genuineness.

$$\text{P13DT} = \text{P1DT'} - \text{P3DT'}$$

$$\text{Discrete value } (4) = \text{ABS } (\text{P13AVE} - \text{P13DT})/\text{P13}\sigma \tag{7}$$

F. Periphery—center difference judgment 2

Judgment is made using the difference between the periphery and the center in the latter half of the pattern when the irregularity of the pattern on the surface of the coin is converted to the basic pattern, where the difference between the standard average P35AVE of the difference between the third change point and the fifth change point and the difference P35DT between the corrected detection data P3DT' and P5DT' is determined and is divided by the standard deviation P35σ, and the result Is the discrete value (see formula (8)), which is compared with the judgment value for judging genuineness.

$$\text{P35DT} = \text{P3DT'} - \text{P5DT'}$$

$$\text{Discrete value } (5) = \text{ABS } (\text{P35AVE} - \text{P35DT})/\text{P35}\sigma \tag{8}$$

G. Pattern standard average—center difference judgment

Judgment is made using the difference between the pattern standard average and the center, where the difference between the standard average PA3AVE of the difference between the pattern standard average PTNMAS and the third change point and the difference PA3DT between the pattern standard average PTNMAS and the corrected detection data P3DT' is determined and is divided by the standard deviation PA3σ and the result is the discrete value (see formula (9)), which is compared with the judgment value for Judging genuineness.

$$\text{PA3DT} = \text{ABS } (\text{PTNMAS} - \text{P3DT'})$$

$$\text{Discrete value } (6) = \text{ABS } (\text{PA3AVE} - \text{PA3DT})/\text{PA3}\sigma \tag{9}$$

H. Correction rate (coefficient) judgment

Genuineness of a coin which has the same pattern but different level is judged, where the difference between the correction rate standard average HOSAVE and correction rate (correction coefficient) of the detection data HOSDT is determined and is divided by the standard deviation HOSσ, and the result is the discrete value (see formula (10)), which is compared with the Judgment value for judging genuineness.

$$\text{Discrete value (7)} = \text{ABS (HOSAVE} - \text{HOSDT)/HOS}\sigma \quad (10)$$

Above is the description on the judgment processing and discrete value calculation methods in Step 202, and the calculation of the total discrete value in Step 204 can be not only accumulating discrete values determined in Step 202 but also calculating discrete values weighted according to the content of each judgment.

In an above described method for detecting outer diameter and a method for detecting pattern of a coin, the coin screening unit 100 judges genuineness of an entered coin based on the judgment result of outer diameter and pattern of the coin and of material of the coin, which is detected in the same method as conventional detection, but a counterfeit coin which is very similar to the genuine coin, such as a foreign coin, can be detected more accurately by accepting only the coins which passed all the judgments as genuine coins and returning the other coins as counterfeit coins.

Figure 9:
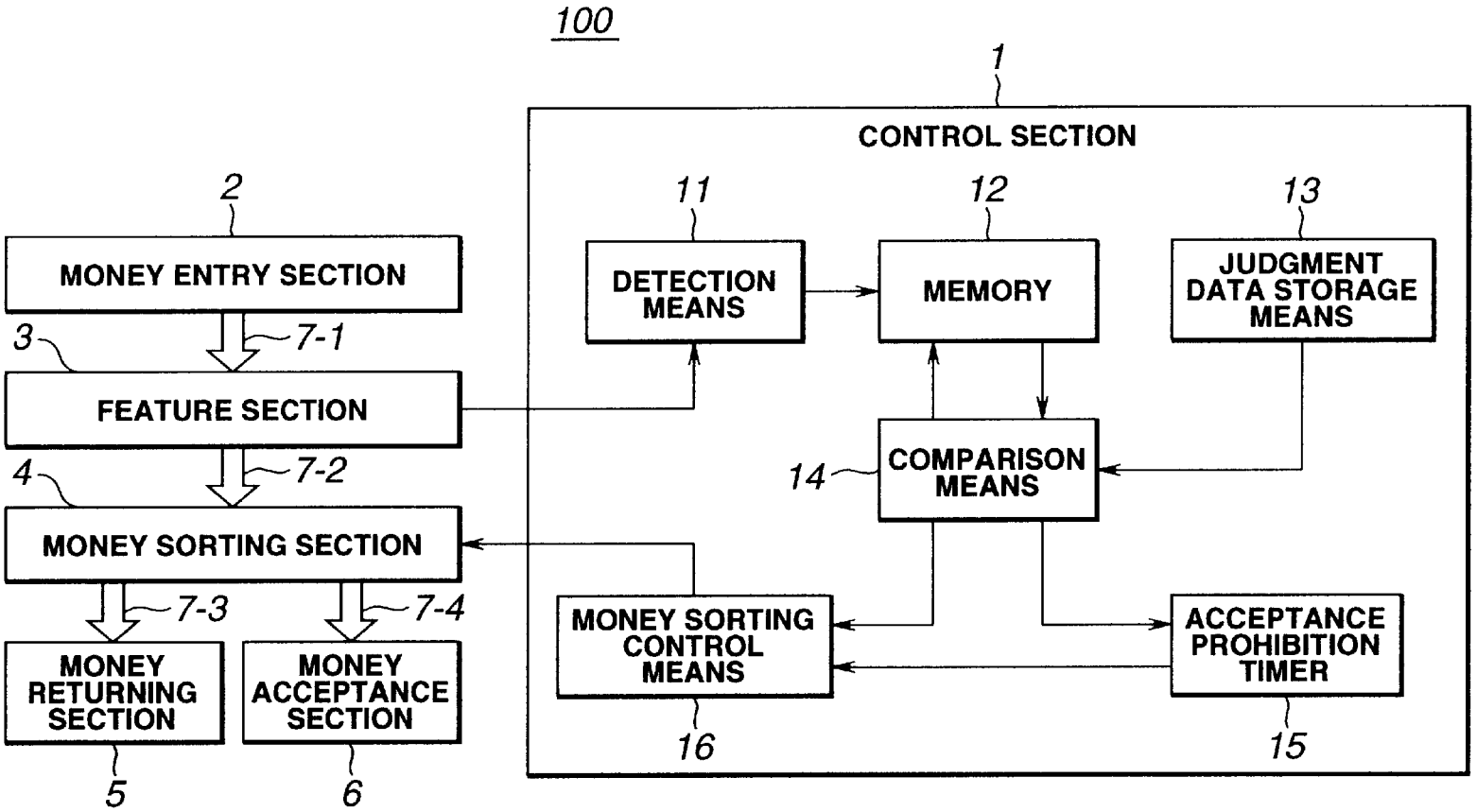
FIG. 9 is a block diagram depicting another configuration of a money screening unit of the invention.

FIG. 9 is a block diagram depicting another configuration of a money screening unit of the invention.

In FIG. 9, the money screening unit 100 comprises a control section 1 for controlling screening of entered money, a money entry section 2 which is an entry slot of money, a feature sensor 3 for detecting features of the money, a money sorting section 4 for sorting the entered money based on control by the control section 1, a money returning section 5 for returning the entered money, a money acceptance section 6 for accepting the entered money, and a money passage 7 (7-1, 7-2, 7-3, 7-4) where the entered money passes through.

The control section 1 comprises detection means 1 for converting output of the feature sensor 3 to specified data, a memory 12 for storing output of the detection means 11 and other information, Judgment data storage means 13 for storing judgment data to be the reference for screening the money, comparison means 14 for judging genuineness of the entered money by comparing output of the detection means 11 and the judgment data stored in the Judgment data storage means 13, an acceptance prohibition timer 15 for measuring time to prohibit acceptance of money, and money sorting control means 16 for controlling the money sorting section 4 based on the comparison result of the comparison means 14 and status of the acceptance prohibition timer 15.

The control section 1 comprises such an arithmetic unit as a CPU and such a storage unit as a memory, and each section indicated by symbols 11 to 16 is created on the arithmetic unit and on the storage unit.

Figure 10:
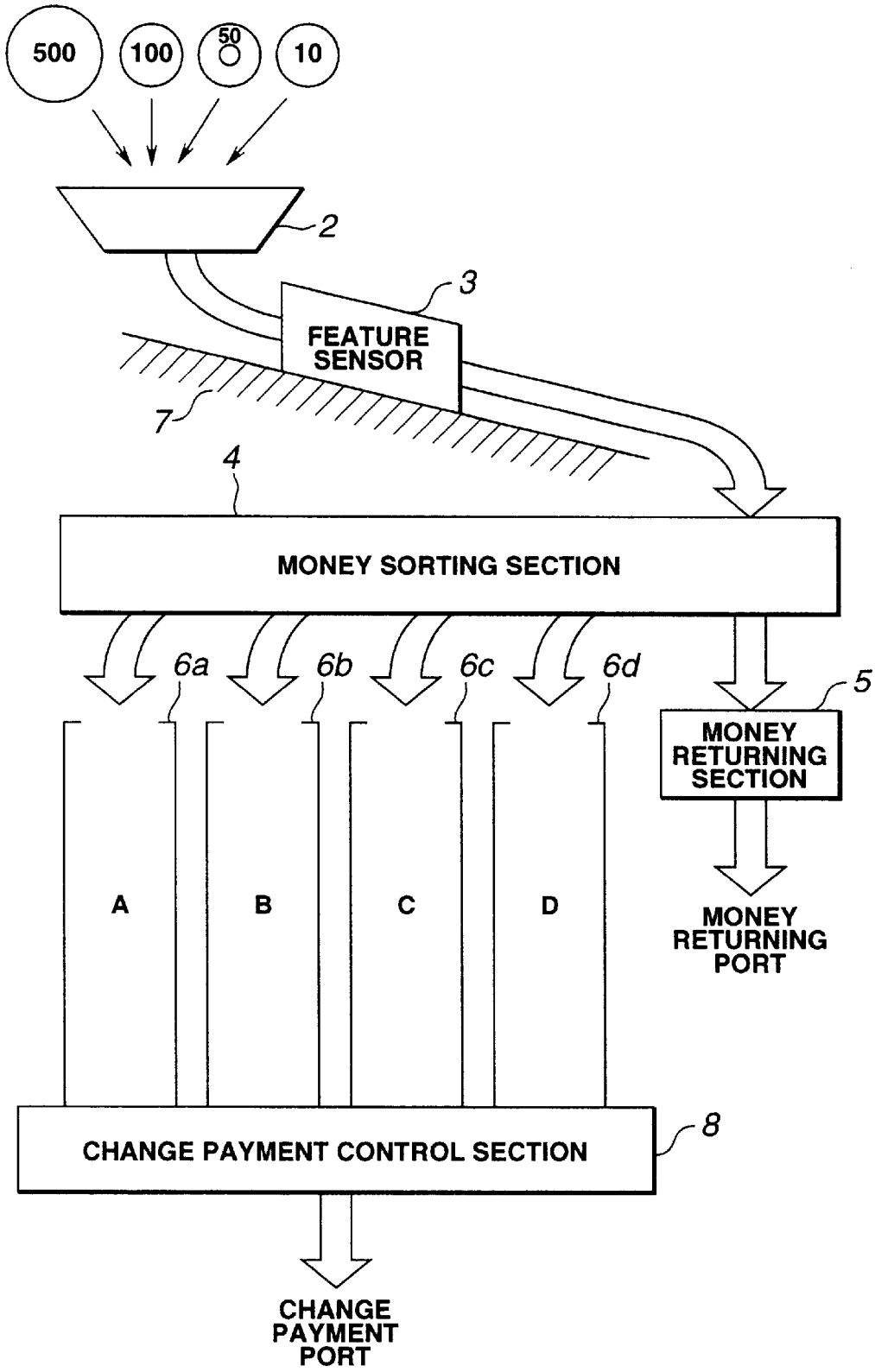
FIG. 10 is a schematic drawing depicting the flow of money in the money screening unit shown in FIG. 9.

FIG. 10 is a schematic diagram indicating flow of money in the money screening unit 100. In FIG. 10, the same symbols as FIG. 2 has been assigned for a section which plays a same function as FIG. 2 for the sake of convenience for explanation.

In the money screening unit in FIG. 10, the money acceptance section 6 has been separated into the money acceptance sections 6*a* to 6*d* so as to accept the entered money for each money type (omitted in FIG. 9).

A change payment control section 8, which is not indicated in FIG. 9, has also been added so that money accepted at the money acceptance sections 6*a* to 6*d* can be paid out as change.

The money entered from the money entry section 2 is transferred to the money sorting section 4 via the money passage 7, and during this transfer, the feature sensor 3 detects features of the money.

Output of the feature sensor 3 is input into the control section 1, and the control section 1 judges genuineness and type of the money based on output of the feature sensor 3, and controls the money sorting section 4.

The money sorting section 4 sorts the money transferred via the money passage 7, based on control signals from the control section 1.

If the control section 1 recognizes the money as a counterfeit money at this time, the money is channeled to the money returning section 5, and is returned from the money returning port to the individual who entered the money.

If the control section 1 recognizes the money as a genuine money at this time, the money is channeled to the money acceptance section 6, then to either one of the money acceptance sections 6*a* to 6*d* depending on the money type.

The money sorted to one of the money sorting sections 6*a* to 6*d* is paid out from the change payment port by the control of the change payment control section 8 if payment of change or other necessities arise.

Figure 11:
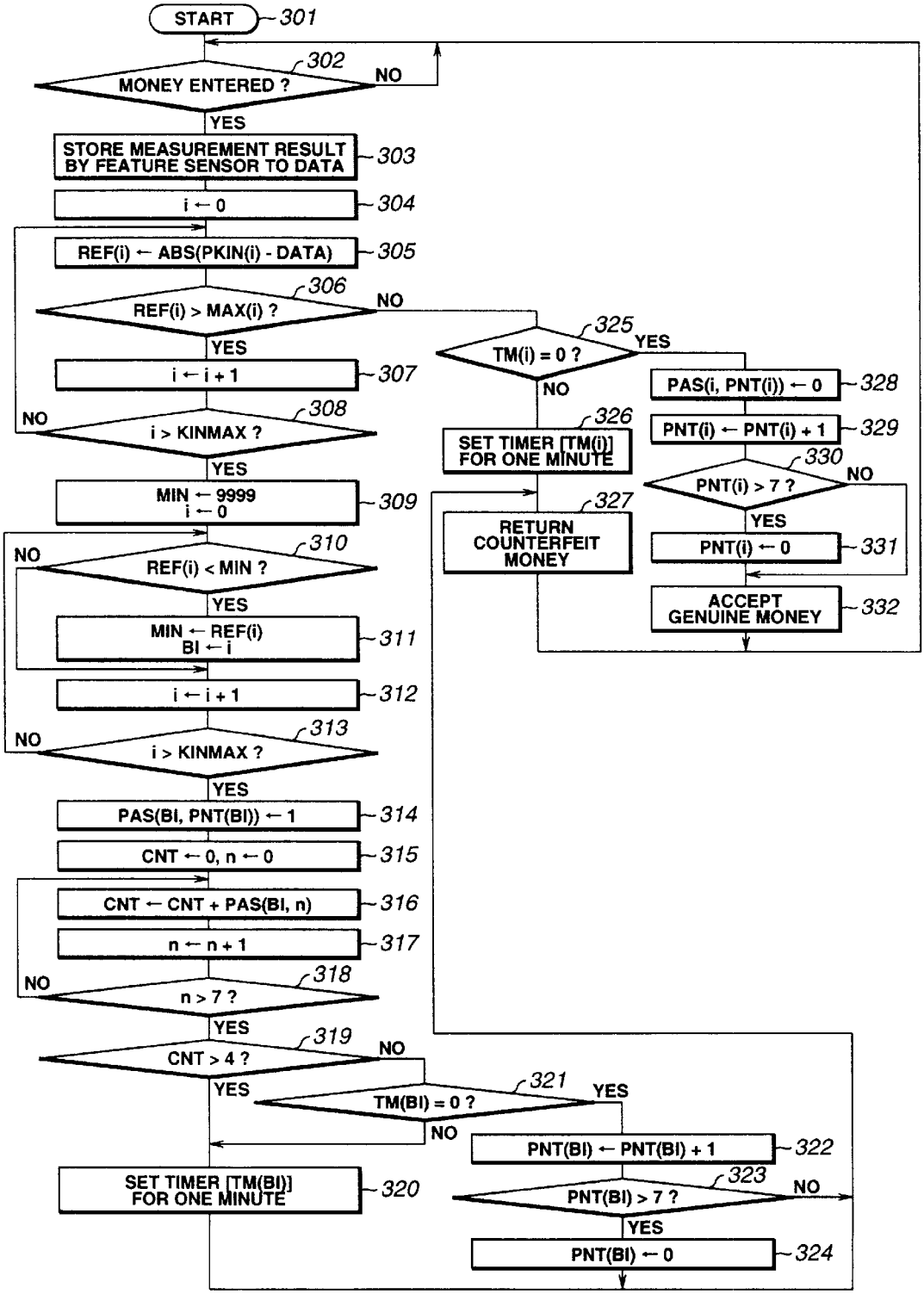
FIG. 11 is a flow chart indicating the flow of a money screening processing at the control section shown in FIG. 9.

FIG. 11 is a flow chart indicating the flow of the money screening processing of the control section 1 shown in FIG. 9. In the description on the flow of the money screening processing, variables and counter values are those created and held in the memory 12, unless otherwise specified.

When the money screening processing starts (Step 301) and the feature sensor 3 detects entry of money (YES in Step 302), the detection means 11 detects features of the money based on output of the feature sensor 3, and stores the detection result to variable DATA (Step 303).

Then the money type counter i is set to "0" as a preparation for comparing the value of the variable DATA and judgment data of each money type (Step 304). The value of the money type counter i indicates the money type, for example, "0" is for a 10 yen coin, "1" is for a 50 yen coin, "2" for a 100 yen coin, and "3" for a 500 yen coin.

When setting of the money type counter i ends, absolute difference between the judgment data PKIN (i) of each money type and the variable DATA is calculated and the result is stored in the variable REF (i) (Step 305).

Then the comparison means 14 compares the variable REF (i) and allowable limit MAX (i) (Step 306), and if the variable REF (i) is smaller, that is, if the absolute difference between the judgment data PKIN (i) and the variable DATA is within the allowable limit MAX (i) (NO in Step 306), processing advances to Step 325, judging the entered coin as a genuine coin with money type i.

If the variable REF (i) is greater than the allowable limit MAX (i) (YES in Step 306), the money type counter i is incremented judging that the entered money type is not the money type indicated by the money type counter i (Step 307).

The processing from Step 305 to Step 307 is repeated until the entered money is judged as money type i (NO in Step 306), or the value of the money type counter i exceeds the value of the maximum money type KINMAX ("3" if a 500 yen coin is set as the maximum), that is, until the money is compared with all the money types (NO in Step 308).

If the money is judged as counterfeit money which does not correspond to any money type in the processing from Step 305 to Step 308 (YES in Step 308), the maximum value of the variable MIN 9999 is stored to the variable MIN and the value of the money type counter i is cleared (Step 309).

Then in the processing from Step 310 to Step 313, it is judged which money type the entered money is closest to.

In this processing, values of the variable REF (i) and the variable MIN are compared (Step 310), and if the value of the variable REF (i) is smaller, the value of the variable REF (i) is stored as a new value of the variable MIN, i, which is a value indicating this money type, is stored to the variable BI (Step 311), and the money type counter i is incremented (Step 312).

The processing from Step 310 to Step 312 is repeated until the value of the money type counter i exceeds the value of the maximum money type KINMAX, that is, until the smallest value among the variable REF (i) of all the money types is stored to the variable MIN (NO in Step 313).

When the smallest value among the variable REF (i) of all the money types is stored to the variable MIN (YES in Step 313), 1, which indicates that counterfeit money has been entered, is stored to the latest acceptance memory PAS (BI, PNT (BI)) indicated by a ring counter PNT (BI) of the money type BI (Step 314). The ring counter PNT (BI) has been holding one of values 0 to 7, therefore the acceptance memory PAS (BI, PNT (BI)) has been holding data for the previous eight entries, with entry of genuine money as "0", and entry of counterfeit money as "1".

Then the values of the variable CNT and the variable n are set to 0 (Step 315), and sum of the values of the acceptance memory PAS (BI, n) of this money type for the previous eight times is stored to the variable CNT in the processing from Step 316 to Step 318.

If the value of the CNT is greater than 4 as a result (YES in Step 319), the timer TM (BI) in the acceptance prohibition timer 15 is set to one minute (Step 320) because five or more entries out of the previous eight times were entries of counterfeits, then the money sorting means 16 controls the money sorting section 4 so as to return the entered money (Step 327), and processing returns to Step 302 while standing by for next entry of money.

If the timer TM (BI) of the acceptance prohibition timer 15 has been activated when the value of CNT is 4 or less (NO in Step 319), that is, if the value of the timer TM (BI) is not "0" (No in Step 321) at this time, the timer TM (BI) is set to one minute again (Step 320), the money sorting means 16 controls the money sorting section 4 so as to return the counterfeit money (Step 327), and processing returns to Step 302 while standing by for next entry of money.

If the timer TM (BI) of the acceptance prohibition timer 15 has not been activated in Step 321 (NO in Step 321), the ring counter PNT (BI) is incremented (Step 322), and if the value of the ring counter PNT (BI) has exceeded 7 (YES in Step 323), the counter is cleared (Step 324), the money sorting means 16 controls the money sorting section 4 so as to return the counterfeit money (Step 327), and processing returns to step 302 while standing by for next entry of money.

When the money entered in Step 306 is judged as a genuine coin with money type i (NO in Step 306), on the other hand, the money sorting control means 16 checks whether the timer TM (i) of the acceptance prohibition timer 15 for the money type i has been activated (Step 325), and if the value of the timer TM (i) is not "0", that is, if the timer TM (i) has been activated (NO in Step 325), the money sorting control means 16 sets the timer TM (i) to one minute again (Step 326), controls the money sorting section 4 regarding the entered money as counterfeit money (Step 327), and processing returns to Step 302 while standing by for next entry of money.

If the timer TM (i) has not been activated (YES in Step 325), "0", which indicates entry of a genuine coin, is stored to the latest acceptance memory PAS (i, PNT (i) indicated by the ring counter PNT (i) of the money type i (Step 328) and the ring counter PNT (i) is incremented (Step 329), then if the value of the ring counter PNT (i) has exceeded 7 (YES in Step 330), the counter is cleared (Step 331), the money sorting means 16 controls the money sorting control section 4 so as to accept the entered coin (Step 332), and processing returns to Step 302 while standing by for next entry of money.

This means that the control section 1 detects features of the money entered from the money entry section 2 based on output of the feature sensor 3, judges whether the entered money is genuine or counterfeit, and if the entered money is counterfeit, the counterfeit money is returned, and if counterfeit money has been entered five or more times out of the previous eight times of money entry, the acceptance prohibition timer 15 is activated.

If the entered money is genuine, the money is accepted only if the acceptance prohibition timer 15 is not operating.

When the acceptance prohibition timer 15 is operating, acceptance is rejected whether the entered money is genuine or counterfeit, and operation time of the acceptance prohibition timer 15 is extended.

Thus the acceptance possibility of entered money is judged for each money type, which decreases the acceptance ratio of counterfeit money caused by the continuous entry attempts.

The maximum value of the ring counter PNT (i) (8 in the present embodiment), the judgment standard in Step 319 (4 in the present embodiment), and the timer set time in Step 320 and Step 327 (one minute in the present embodiment) can be freely set.

Also in the processing from Step 310 to Step 313, an entered counterfeit money is sorted to the closest money type, however an entered counterfeit money which is completely different from genuine money can be outside the processing target by setting tolerance.

The present embodiment described a money screening method and unit targeting coins, but this is an example, and acceptance control of a money screening unit targeting bills can also be performed in the same manner.

Acceptance control for securities and notes can also be performed in the same manner. (The money used in the present description is not only coins and bills but also includes securities and notes.)

What is claimed is:

1. A money screening method comprising the steps of detecting features of a coin rolling through a coin passage by a at least one sensor disposed along the coin passage, judging genuineness of the coin based on a detection result, accepting the coin if it is judged as genuine in the judgment and returning the coin if it is judged as counterfeit in the judgment, wherein:

an output of the sensor is summarized to a specific number of data;

the summarized data is converted to basic pattern data;

the converted basic pattern data is compared with reference data which has been set in advance for each money type;

genuineness of the coin is judged based on a comparison result; and the summarization is implemented by selecting specified number of data out of change points where the output of the sensor changes from ascending to descending and from descending to ascending, and the conversion is implemented by rearranging the summarized data in specified sequence.

2. The money screening method according to claim 1, wherein genuineness judgment of the coin is implemented based on: a discrete value indicating a difference between the basic pattern data for each one of multiple items and the reference data; and a sum of the discrete values corresponding to all of the multiple items.

3. The money screening method according to claim 1, wherein the comparison is performed also for the reference data corresponding to a counterfeit coin similar to a genuine coin; and when the result of the comparison is judged as applicable to both of the genuine coin and the counterfeit coin, the coin is judged as applicable to the genuine coin or the counterfeit coin for which approximity is higher in the comparison result.

4. A money screening method comprising the steps of detecting features of a coin rolling through a coin passage by a plurality of sensors disposed at a specified interval along the coin passage, judging genuineness of the coin based on a detection result, accepting the coin if it is judged as genuine in the judgment and returning the coin if it is judged as counterfeit in the judgment, wherein:

the plurality of sensors detect at least a material, an outer diameter and a surface pattern of the coin;

the diameter is detected by detecting features including a thickness of the coin based on a time difference in detection of entry of the coin by the plurality of sensors in the coin passage whose base is inclined at a specified angle toward a direction perpendicular to the coin rolling direction;

the surface pattern is detected by summarizing outputs of the sensors to specified number of data, converting the summarized data to basic pattern data, and comparing the converted basic pattern data with reference data which has been set in advance for each money type;

each detection result is compared with reference values which have been set in advance, and genuineness of the coin is judged based on the comparison result; and the summarization is implemented by selecting specified number of data out of change points where the outputs of the sensors change from ascending to descending and from descending to ascending, and the conversion is implemented by rearranging the summarized data in specified sequence.

5. The money screening unit according to claim 4, further comprising:

time difference detection means for detecting a time difference in detection of entry of the coin by the plurality of sensors; and outer diameter detection means for detecting an outer diameter of the coin based on the time difference detected by the time difference detection means.

6. The money screening unit according to claim 5, wherein:

the plurality of sensors are at least three sensors;

the time difference detection means comprises:

first time difference detection means for detecting a time one from when a first sensor among the three sensors first detects entry of the coin to when a second sensor among the three sensors secondly detects entry of the coin; and second time difference detection means for detecting a time two from when the first sensor detects entry of the coin to when a third sensor among the three sensors thirdly detects entry of the coin, and the outer diameter detection means comprises:

time ratio calculation means for calculating a ratio between a time detected by the first time difference detection means and a time detected by the second time difference detection means; and time ratio comparison means for comparing the ratio calculated by the time ratio calculation means and a preset reference value.

7. The money screening unit according to claim 5, wherein the coin passage has a base which is inclined at a specified angle toward a direction perpendicular to the coin rolling direction.

8. A money screening unit, comprising:

at least one sensor disposed at a coin passage;

data summarization means for summarizing an output of the sensor to a specified number of data;

basic pattern data conversion means for converting the data summarized by the summarization means to basic pattern data;

basic pattern data comparison means for comparing the basic pattern data acquired after conversion by the basic pattern conversion means with reference data which has been set in advance for each money type; and coin screening means for detecting features of the coin rolling through the coin passage based on the comparison result by the basic pattern data comparison means, judging genuineness of the coin based on the detection result, accepting the coin if it is judged as genuine in the judgment and returning the coin if it is judged as counterfeit by the judgment means, wherein the summarization means comprises change point detection means for detecting a change point where the output of the sensor changes from ascending to descending and from descending to ascending, and data selection means for selecting a specified number of data from the data on the change points detected by the change point detection means, and wherein the basic pattern conversion means rearranges the data summarized by the summarization means to a specified sequence.

9. The money screening unit according to claim 8 further comprising:

discrete value calculation means for calculating a discrete value that indicates a difference between the basic pattern data and the reference data for each one of multiple items; and total discrete value calculation means for calculating the sum of the discrete values for all of the multiple items.

10. The money screening unit according to claim 8 wherein the basic pattern data comparison means further comprises approximity judgment means for comparing the basic pattern data with the reference data for a counterfeit coin similar to a genuine coin, and when the comparison result is judged as applicable to both the genuine coin and the counterfeit coin, judging the coin as applicable to the genuine coin or the counterfeit coin for which approximity is higher in the comparison result.

11. A money screening unit, comprising:

a plurality of sensors disposed at a specified interval along a coin passage;

coin material detection means for detecting a material of the coin based on outputs of the plurality of sensors;

coin outer diameter detection means for detecting an outer diameter of the coin based on a time difference in detection of entry of the coin by the plurality of sensors;

coin pattern detection means where the outputs of the sensors are summarized to a specified number of data, the summarized data is converted to basic pattern data, and a surface pattern of the coin is detected by comparing the basic pattern data with reference data which has been set in advance for each money type;

judgment means for judging genuineness of the coin based on the detection outputs of the coin material detection means, the coin outer diameter detection means and the coin pattern detection means; and coin screening means for accepting the coin judged as genuine by the judgment means and returning the coin judged as counterfeit by the judgment, wherein the coin pattern detecting means comprises:

change point detection means for detecting a change point where the outputs of the sensors change from ascending to descending and from descending to ascending;

data selection means for selecting a specified number of data from the data on the change points detected by the change point detection means; and basic pattern conversion means for rearranging the summarized data to a specified sequence.

* * * * *